US006935205B2

(12) United States Patent
Danek

(10) Patent No.: US 6,935,205 B2
(45) Date of Patent: Aug. 30, 2005

(54) SWITCH ACTUATOR

(75) Inventor: Daniel J. Danek, Berwyn, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 43 days.

(21) Appl. No.: 10/190,385

(22) Filed: Jul. 3, 2002

(65) Prior Publication Data

US 2004/0003676 A1 Jan. 8, 2004

(51) Int. Cl.[7] ..... F02D 1/00
(52) U.S. Cl. ..... 74/513; 74/54; 123/399; 200/573
(58) Field of Search ..... 74/54, 512, 513; 200/19.2, 19.21, 19.27, 573, 574; 123/399, 400

(56) References Cited

U.S. PATENT DOCUMENTS 2,238,383 A * 4/1941 Collins ..... 200/249
2,255,012 A * 9/1941 Lake et al. ..... 200/19.21
2,539,567 A * 1/1951 Best ..... 335/23
2,578,632 A * 12/1951 Miller ..... 200/38 R
2,956,437 A * 10/1960 Opocensky ..... 74/54
4,876,764 A * 10/1989 Teague, Jr. ..... 16/71
6,242,706 B1 * 6/2001 Miyata ..... 200/537

* cited by examiner

*Primary Examiner*—William C. Joyce
(74) *Attorney, Agent, or Firm*—Mark W. Croll, Esq.; Paul F. Donovan, Esq.; Welsh & Katz, Ltd.

(57) ABSTRACT

A switch actuator is provided with a rotor in a housing and a third class lever having a cam follower operatively engaged against a cam surface of the rotor. A fulcrum of the lever is provided at a location relative to the rotor, which location is adjustable relative to the rotor in response to continued rotation of the rotor after an operative end of the lever has been stopped against a switch.

17 Claims, 2 Drawing Sheets

SWITCH ACTUATOR

FIELD OF THE INVENTION

The present invention pertains generally to actuator mechanisms, and, more specifically, to actuator mechanisms for switches such as found in a throttle control mechanism of a gas powered golf cart.

BACKGROUND OF THE INVENTION

Remote actuators having cam surfaces for driving one or more levers are known for various purposes. By way of example, in a known design of a throttle control mechanism for a gas powered golf cart, several different switches are actuated when the driver depresses an acceleration pedal. Through appropriate linkage mechanism, depressing the pedal causes rotational movement of a rotor in an actuator. The rotor has a cam surface, the movement of which moves levers having cam followers. Movement of the levers actuates switches. Two such switches are actuated in known gas-powered golf cart designs. Upon depressing the pedal, a kill switch opens, and a solenoid switch closes, thereby starting the gas engine. When the cart is stopped, and the accelerator pedal is released from continued pressure, the kill switch is closed stopping the engine, and the solenoid switch is opened, preventing ignition.

It is desirable to keep the circuitry, actuators, levers and linkages compact, to minimize space requirements and reduce overall vehicle size. Thus, it is desirable to control the magnitude of movement required of the levers for complete actuation of the switches. When properly adjusted within specification tolerances, operation is smooth and efficient. However, relatively small adjustment errors can be magnified along the linkage train, resulting in over rotation of the cam rotor. In a vehicle such as a golf cart, which operates over uneven terrain, and may be subject to a degree of misuse or abuse, misadjustment can occur with some regularity. Components can move slightly, as mounting structures loosen over time. The resultant change in switch mechanism location and/or linkage operation can be either an under rotation or an over-rotation of the cam relative to the switch operation in either or both directions.

Over rotation of the cam rotor, and excessive movement of the levers relative to the switch position can cause levers to bottom out on the switch casing and be subjected to excessive continued force. The result can be damage to the levers and/or damage to the switches operated by the levers. Problems associated with over-rotation of the cam rotor are particularly troublesome when the over-rotation occurs in the static or at-rest position of the device, which may exist for an extended period of time. The prolonged effect of over-rotation present in the at-rest position can lead to unsuspected damage the next time the device is operated.

What is needed is a means for absorbing the excessive force and over rotation, to minimize potential damage of the levers or switches in a cam-operated linkage mechanism.

SUMMARY OF THE INVENTION

The present invention provides a means for protecting switches and levers from excessive force caused by over rotation of a cam rotor operating the levers, by providing the lever with a moveable fulcrum, thereby limiting the pressure exerted by the lever against the switch mechanism.

In one aspect thereof, the present invention provides an actuator unit with a housing, a cam and a lever. The lever has a first end, a second end and a cam follower slidably engaged against the cam. A connection between the lever second end and the housing defines a fulcrum for the lever relative to the housing. The connection is movable relative to the cam. Biasing means urges the lever second end in one direction.

In another aspect thereof, the invention provides an actuator with a housing, and a rotor in the housing. The rotor has a cam surface. A third class lever has a cam follower engaged against the cam surface, and has a fulcrum at a location that is movable relative to the rotor.

In yet another aspect thereof, the invention provides a throttle control unit for a golf cart with a housing and a rotor rotatably disposed in the housing. The rotor has a cam surface. A drive linkage is connected to the rotor for imparting rotation thereto. A third class lever has a first end, a second end and a cam follower riding on the cam surface. A fulcrum at one of the ends is movable relative to the rotor. A switch is engaged against the lever at the other end of the lever, and a biasing means urges the location of the fulcrum toward the rotor.

In a further aspect thereof, the invention provides a method for actuating a switch, with steps of providing a switch and a third class lever for operating the switch, the lever having a first end operatively engaged against the switch and a second end defining a fulcrum; providing a rotor adjacent the lever, a cam surface on the rotor and a cam follower on the lever engaged against the cam surface of the rotor; rotating the rotor for moving the lever; providing a stop for the first end of the lever; stopping the first end of the lever; and moving the second end of the lever in response to continued rotation of the rotor after stopping the first end of the lever.

An advantage of the present invention is providing a switch actuator that relieves excess pressure on a switch caused by over rotation of a cam lever actuator.

Another advantage of the present invention is providing a switch actuator that is robust and suitable for use on a golf cart.

Yet another advantage of the present invention is providing a switch actuator that compensates for over rotation of a cam in the actuator.

Other features and advantages of the invention will become apparent to those skilled in the art upon review of the following detailed description, claims and drawings in which like numerals are used to designate like features.

Figure 1:
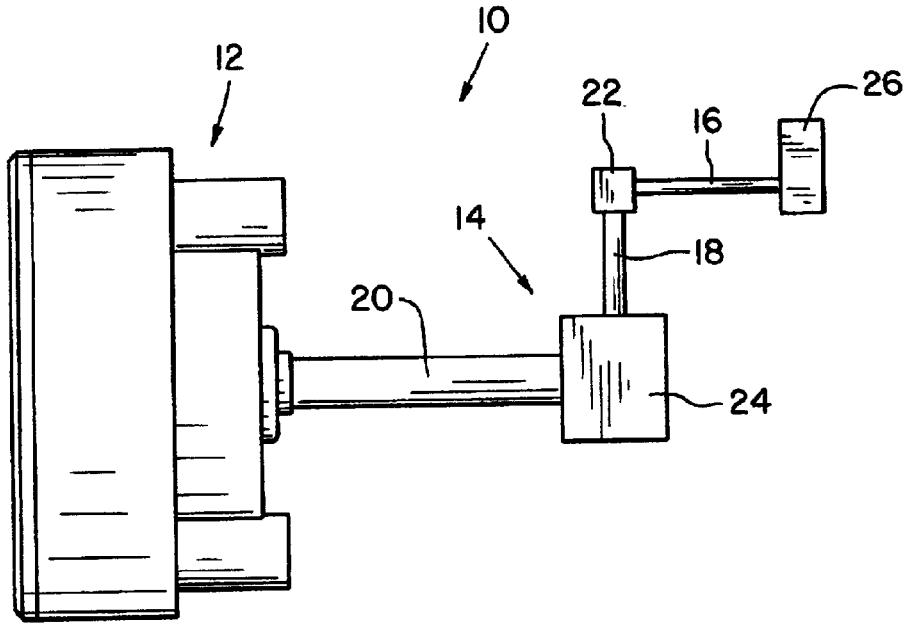
FIG. 1 is an elevational view, in partial schematic, of an accelerator pedal system for a golf cart or the like, the mechanism having a switch actuator of the present invention.

Before the embodiments of the invention are explained in detail, it is to be understood that the invention is not limited in its application to the details of construction and the arrangements of the components set forth in the following description, or illustrated in the drawings. The invention is capable of other embodiments, and of being practiced or being carried out in various ways. Also, it is understood that the phraseology and terminology used herein are for the purpose of description and should not be regarded as limiting. The use herein of "including", "comprising", and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings, and to FIG. 1 in particular, a golf cart accelerator pedal system 10 is shown, which includes a switch actuator 12 in accordance with the present invention. While the present switch actuator 12 is shown with respect to use in a gas powered golf cart, it should be understood that actuator 12 of the present invention can be used for other devices, and for switching apparatuses other than accelerator systems. Use in a gas powered golf cart is merely a suitable, advantageous use of the invention.

Switch actuator 12 is shown disproportionately large in FIG. 1, in comparison to other components of system 10. Actuator 12 is connected to a linkage train 14 including shafts 16, 18 and 20, and interconnecting gears and/or linkages depicted schematically by boxes 22 and 24. A foot pedal 26 is provided connected to shaft 16, for actuation of system 10, by depressing or releasing foot pedal 26. It should be understood that the components in accelerator pedal system 10, such as shafts 16, 18, 20 and gears represented by boxes 22 and 24 and foot pedal 26 depict a suitable environment for use of the invention, and other linkage trains also can be used.

Figure 2:
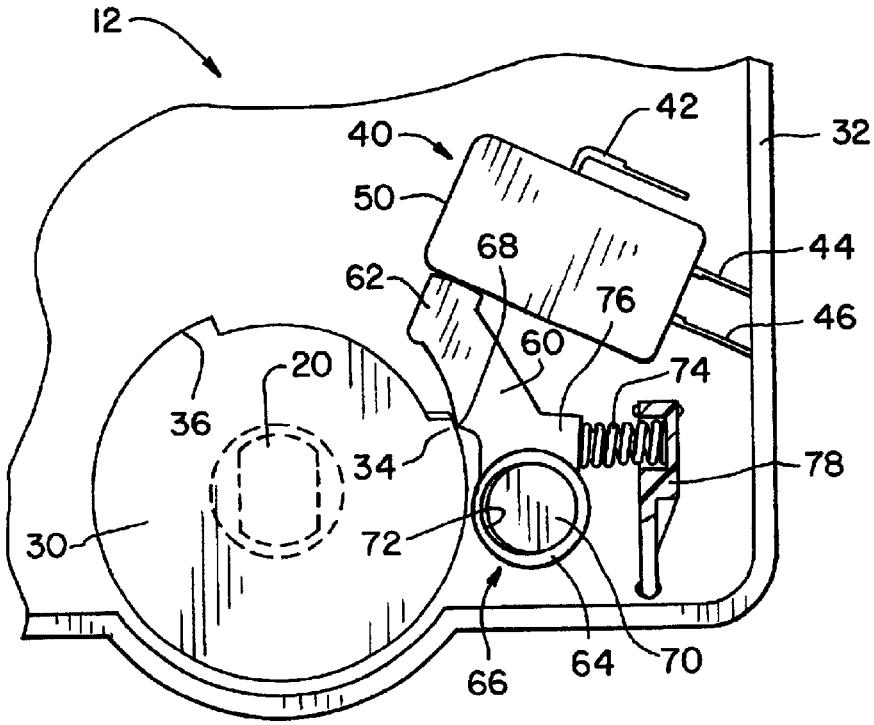
FIG. 2 is an enlarged view of the switch actuator of the present invention, shown in a first position of operation.
Figure 3:
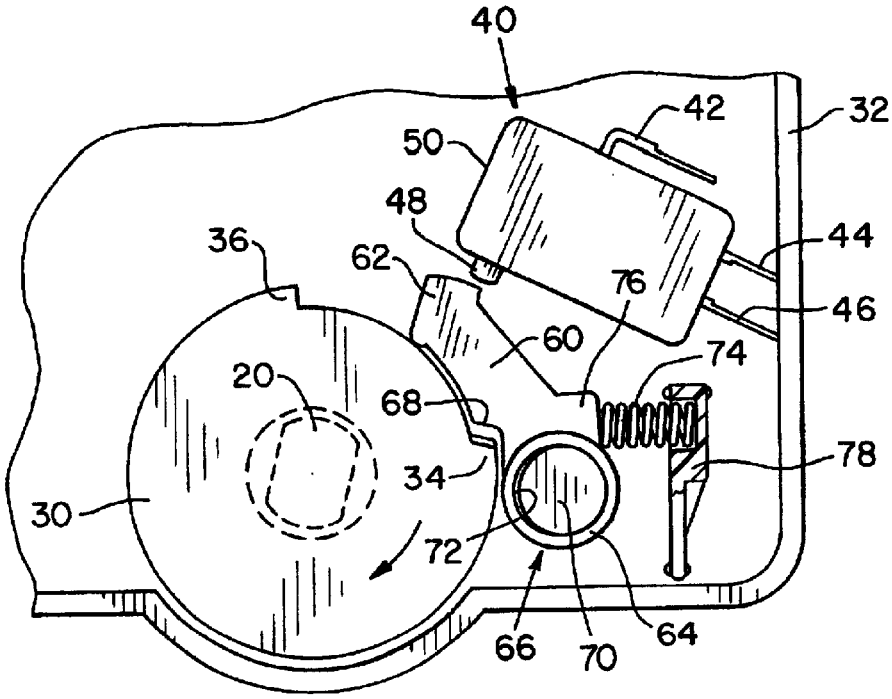
FIG. 3 is a view of the switch actuator of FIG. 2, but showing a second position of operation.
Figure 4:
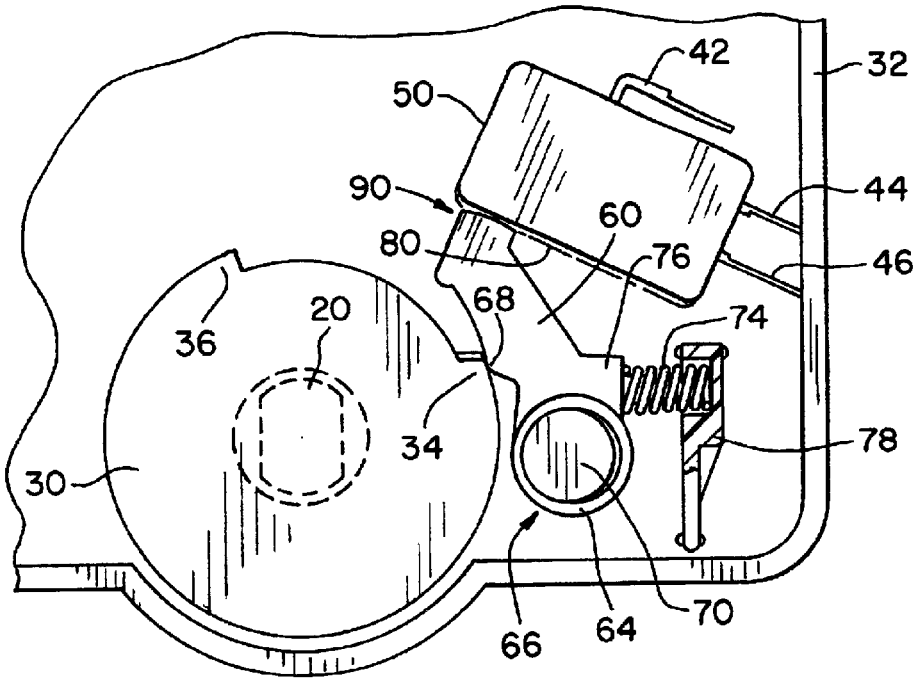
FIG. 4 is a view of the switch actuator of FIGS. 2 and 3, but showing another condition of operation.

Switch actuator 12 includes a rotor 30 attached to shaft 20, for rotation of rotor 30 by shaft 20 upon a user depressing pedal 26, or releasing pedal 26 from a depressed position. Rotor 30 is contained within a housing 32, and is suitably mounted in housing 32 for rotation therein. Rotor 30 rotates upon depressing pedal 26, or upon releasing pedal 26 from a depressed position, and may rotate through only a relatively small arc less than a complete revolution of rotor 30. Rotor 30 is shaped to include one or more lobes or cams 34, 36, and as depicted in the drawings (FIGS. 2–4) includes two cams 34, 36. One or more switches 40 having electrical leads 42, 44, 46 attached thereto are operated upon rotation of rotor 30, via a switch button 48 housed in a switch casing 50. One such switch 40 is shown in FIGS. 2–4. A lever 60 operates switch button 48, with switch button 48 being depressed or released by movement of lever 60. Lever 60 is caused to move against or away from switch button 48 upon rotation of rotor 30, as will be described more fully hereinafter.

Lever 60 is a third class lever, having a first end 62 operatively positioned in association with switch 40 for depressing button 48, and a second end 64 forming and defining with housing 12 a fulcrum 66 for lever 60. A cam follower 68 is provided between first end 62 and second end 64. Cam follower 68 is operatively associated with cams 34, 36 of rotor 30.

Fulcrum 66 is created by a knob 70 of housing 32 disposed in an oblong opening 72 formed in lever 60 at second end 64. Knob 70 and opening 72 are operatively associated such that lever 60 can rotate about knob 70 in opening 72. The shape of opening 72 is oriented with respect to rotor 30 such that opening 72, and thus second end 64 of lever 60, can slide slightly away from rotor 30 under conditions to be described subsequently herein.

A biasing means in the nature of a spring 74 is provided to urge second end 64 of lever 60 toward rotor 30. Spring 74 is operatively connected between a boss 76 on lever 60 and a spring retainer 78 in housing 32.

A desirable "at rest" position for switch actuator 12 is shown in FIG. 2. Lever 60 is moved by cam 36 to depress button 48. To activate system 10 from the "at rest" position, foot pedal 26 is depressed, causing rotor 30 to rotate in a clockwise direction as depicted in FIG. 3. First end 62 of lever 60 falls away from button 48 as cam follower 68 slides past cam 36. FIGS. 2 and 3 thus illustrate the desired positions when system 10 and actuator 12 thereof are operating within designed conditions. Spring 74 urges second end 64 toward rotor 30, such that knob 72 is engaged against a surface of opening 72 that is furthest from rotor 30.

Under desired "at rest" conditions, first end 62 of lever 60 gently touches casing 50 of switch 40, with switch button 48 being fully depressed. However, as illustrated in FIG. 4, through various mispositionings or tolerance stack up, it is possible for casing 50 to be slightly mispositioned relative to first end 62 of lever 60. The potential relative mispositioning of casing 50, for example, is illustrated by the dashed line shown in FIG. 4, indicated by numeral 80. Under this condition, as first end 62 of lever 60 bottoms out prematurely against casing 50, rotor 30 continues to rotate, and the action of cam 36 would, absent the present invention, urge first end 62 of lever 60 more firmly against casing 50. This condition could result in damage. However, as a result of the present invention, lever 60 adjusts such that opening 72 moves along knob 70, to effectively absorb the over-force applied against cam follower 68. Lever 60 is allowed to pivot at the contact of end 62 against casing 50. Essentially, a fulcrum 90 is formed at first end 62, as end 62 bottoms out against casing 50 and the biasing force of spring 74 is overcome. Second end 64 moves laterally, as opening 72 is allowed to slide along knob 70, until knob 70 contacts the area of opening 72 nearest rotor 30, as shown in FIG. 4.

The present invention compensates for tolerance stack-up or potential component mispositioning by allowing flexibility in the relative position of a lever fulcrum with respect to the force applied to the lever. In the present invention, a third class lever has force applied thereto intermediate first and second ends of the lever. The first end of the lever moves as a spring biased fulcrum is created at the second end. Upon the lever first end encountering resistance to continued movement, continued application of force on the lever overcomes the spring biasing force, causing the fulcrum of the lever to occur at the first end, and allowing the second end of the lever to move.

Variations and modifications of the foregoing are within the scope of the present invention. It is understood that the invention disclosed and defined herein extends to all alternative combinations of two or more of the individual features mentioned, or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A vehicle throttle control unit, actuator, comprising:

a housing;

a pedal a cam operatively connected to the pedal;

a lever including a first end, a second end and a cam follower slidably engaged against said cam;

a connection between said lever second end and said housing, said connection defining a fulcrum for said lever relative to said housing, said connection being movable relative to said cam, the connection formed by a knob and an oblong opening; and biasing means urging said lever second end in one direction, wherein the lever pivots about the connection between a first position and a second position and wherein the lever is movable such that the oblong opening of the connection shifts along the knob to absorb and over-force applied against the cam follower as the lever pivots about the connection.

2. The actuator of claim 1, said cam being disposed on a rotor.

3. The actuator of claim 2, said knob being formed in said housing and said oblong being formed in said lever for receiving said knob.

4. The actuator of claim 2, said biasing means being a spring.

5. The actuator of claim 4, said connection including a knob in said housing and an oblong opening defined by said lever for receiving said knob.

6. The actuator of claim 1, said connection including a knob in said housing and an oblong opening defined by said lever for receiving said knob.

7. The actuator of claim 1, said biasing means being a spring.

8. A vehicle throttle control unit actuator comprising:

a housing;

a pedal;

a rotor in said housing and operatively connected to the pedal, a pedal; said rotor having a cam surface;

a third class lever having a cam follower engaged against said cam surface and having a fulcrum at a location relative to said rotor; and a connection between said lever and said housing formed by a knob and an elongated opening;

said location of said fulcrum being movable toward and away from said rotor between a first position and a second position, wherein said lever rotates about said fulcrum when said fulcrum is at said first position and at said second position and at positions therebetween, said cam surface and said cam follower maintaining engagement with one another when said lever rotates and when said fulcrum moves between said first and second positions at said connection by movement of said knob relative to said elongated opening to absorb an over-force applied against said cam follower as the lever rotates, to accommodate mispositioning and tolerances of a switch against which the lever bears.

9. The actuator of claim 8, including biasing means urging said location toward said rotor.

10. The actuator of claim 8, said knob being formed in said housing and being disposed in said elongated opening formed in said lever.

11. The actuator of claim 10, including biasing means urging said location toward said rotor.

12. The actuator of claim 11, said opening comprising and oblong opening.

13. The actuator of claim 12, said biasing means being a spring.

14. The actuator unit, comprising:

a housing;

a rotor rotatably disposed in said housing, said rotor having a cam surface;

a drive linkage connected to said rotor for importing rotation thereto;

a third class lever having a first end and a second end and a cam follower riding on said cam surface, and having a fulcrum at one of said ends, said fulcrum being at a movably location relative to said rotor;

a switch engaged against said lever at the other end of said lever; and biasing means urging said location of said fulcrum toward said rotor, wherein said drive linkage includes a foot actuated pedal of a throttle control unit for a golf cart.

15. The actuator unit of claim 14, said fulcrum including a knob in said housing disposed in an opening defined by said lever.

16. The actuator unit of claim 15, said opening being an oblong opening.

17. The actuator unit of 16, said biasing means being a spring.

* * * * *

UNITED STATES PATENT AND TRADEMARK OFFICE

CERTIFICATE OF CORRECTION

PATENT NO. : 6,935,205 B2
DATED : August 30, 2005
INVENTOR(S) : Daniel J. Danek

It is certified that error appears in the above-identified patent and that said Letters Patent is hereby corrected as shown below:

Column 5,
Line 13, should read -- ...to absorb an over-force… --.
Line 19, should read -- ...said oblong opening being formed in said lever… --.

Column 6,
Line 17, should read -- ...said opening comprising an oblong opening… --.
Line 22, should read -- An actuator unit, comprising: --.
Line 32, should read -- ...being at a movable location relative… --.

Signed and Sealed this

Twenty-eighth Day of February, 2006

JON W. DUDAS
*Director of the United States Patent and Trademark Office*